US007041984B2

(12) United States Patent
Ellefson et al.

(10) Patent No.: US 7,041,984 B2
(45) Date of Patent: May 9, 2006

(54) REPLACEABLE ANODE LINER FOR ION SOURCE

(75) Inventors: Robert E. Ellefson, Manlius, NY (US); Louis C. Frees, Manlius, NY (US)

(73) Assignee: Inficon, Inc., East Syracuse, NY (US)

( * ) Notice: Subject to any disclaimer, the term of this patent is extended or adjusted under 35 U.S.C. 154(b) by 0 days.

(21) Appl. No.: 10/849,765

(22) Filed: May 20, 2004

(65) Prior Publication Data

US 2005/0258374 A1 Nov. 24, 2005

(51) Int. Cl.
*H01J 27/02* (2006.01)

(52) U.S. Cl. ..... 250/427; 250/423 R; 315/111.91; 315/111.81; 60/202

(58) Field of Classification Search ..... 250/427, 250/423 R; 315/111.91, 111.81; 60/202
See application file for complete search history.

(56) References Cited

U.S. PATENT DOCUMENTS 4,123,686 A * 10/1978 Keller et al. ..... 313/230
6,064,156 A * 5/2000 Patterson et al. ..... 315/111.91
6,765,216 B1 * 7/2004 Kagadei et al. ..... 250/423 R

* cited by examiner

*Primary Examiner*—Nikita Wells
*Assistant Examiner*—Zia R. Hashmi
(74) *Attorney, Agent, or Firm*—Peter J. Bilinski

(57) ABSTRACT

A releasable anode liner that is fitted within the interior of the anode of an ion source. The cover permits electrons to be projected into the anode wherein any insulating deposits adhere to the interior of the anode liner, thereby increasing the effective life of the anode without premature replacement or repair.

35 Claims, 4 Drawing Sheets

REPLACEABLE ANODE LINER FOR ION SOURCE

FIELD OF THE INVENTION

The invention relates to the field of mass analyzers, and in particular to a replaceable anode liner for an ion source, such as those used in semiconductor process monitoring.

BACKGROUND OF THE INVENTION

It is known that certain semiconductor wafer monitoring processes utilize mass spectrometers or other apparatus in order to determine the presence and relative amount of process gases. A number of these processes, such as those, for example, utilizing Chemical Vapor Deposition (CVD) techniques, contain volatile silicon and/or other species which can cause a mass spectrometer monitoring the process to lose sensitivity in a relatively short period of time; that is, as compared to the average lifespan of an ion source typically used in conjunction with the spectrometer. More succinctly, the resulting problem that ensues is that the ion source can lose required sensitivity in a matter of days, as opposed to the normal or typical lifetime (e.g., months) of the ion source, thereby necessitating premature replacement of same.

This loss in sensitivity noted above is attributable to the accumulation of insulating deposit on the interior of the anode of the ion source. Typical ion sources are depicted in FIGS. 1 and 2, while a mass analyzer system 31 incorporating same is illustrated in FIG. 3. For purposes of better describing the problems, reference is made to each of these Figs.

First and with regard to FIGS. 1 and 2, a pair of ion sources 10, 30 is shown. Components commonly used in each of these sources and referred to herein are labeled with the same reference numerals for the sake of clarity.

As to the differences between the depicted ion sources 10, 30, some ion source manufacturers have used replaceable anodes in which the whole element is replaced or removed for cleaning, such as those, for example, in an ion source that was manufactured by Leybold Inficon of East Syracuse, N.Y. for their Q-Mass sensor system. Typically, these organic mass spectrometer units have gas entry extending from a gas chromatograph or other form of output that enters the side of the anode (i.e., laterally),as shown in FIG. 1, representative of a portion of the known ion source 10.

However and for vacuum processing applications, process analyzers based on residual gas analyzers (RGAs) such as the Compact Process Monitor manufactured by Inficon, Inc., typically have a closed ion source 30, such as shown in FIG. 2.

Each of the ion sources 10, 30 commonly include an electron stream producing means, in this case a heated filament 14, typically made from tungsten or a similar material that forms an electron stream which projects into the structure of the anode 18, 32, respectively. As noted above, the anode 18 according to the ion source 10 of FIG. 1 is replaceable, the anode being shown in both the assembled and unassembled positions in the figure, while the closed ion source 30 of FIG. 2 includes a fixed anode 32 with supporting structure such as a sealed disk 34 at the upper end thereof.

Electrons that are formed from the heated filament 14 of each ion volume 10, 30 are expelled into an ionization volume or region within the interior of the anode 18, 32. The potential of the anode 18, 32 is positive with respect to the filament and an electron repeller (not shown). Reagent gases from a deposition chamber or other source to be monitored are provided into the ionization volume. As noted above and in the instance of the ion source 10, the gases are provided laterally through a port 22 while in the ion source 30, the gases are provided axially; that is, the gases are introduced in a direction 27 that is substantially perpendicular to the direction of the electron stream through the anode 32.

An example mass analysis system 31 is shown in FIG. 3 in which a sensor 33, that houses the ion detector and Quadrupole mass detector, is arranged relative to a vacuum test chamber 35 and a vacuum pump 37 that draws the reagent gases into the ionization volume. Gas, from process 20 is supplied to the closed ion source 30 by means of a flow control orifice 21. Additional details concerning the above system are provided in U.S. Pat. No. 5,889,281, the entire contents of which are herein incorporated by reference.

In each ion source 10, 30, the ions resultingly formed in the confines of the ionization volume are pulled by appropriate potential through an ion lens assembly that comprises at least one focus plate or extractor 24 and a parallel and concentric exit lens 29. The plate 24, having less positive potentials to that of the anode 18, 32, serves to accelerate the formed positive ions as a focused ion beam 26 through concentric openings 28 in the ion lens assembly along an axis 25 to a mass filter or other apparatus (not shown in FIGS. 1 and 2), such as a quadrupole. Insulators 38 are provided in the lens assembly of each ion source 10, 30 to prevent gas leakage. In quadrupole mass spectrometers (hereinafter referred to QMS) especially, the sensitivity (that is, the ion current that is detected in ratio to the ion source partial pressure) is extremely dependent upon ion energy.

In either instance, the electron beam heating the anode surface can induce the formation of an insulating deposit layer 39 from the CVD reagent gases that are being monitored. Subsequently, the same electron beam accumulates electrons on the insulated deposit layer surface 39, forming a negative surface charge and generating an electrical potential that is negative with respect to the anode.

Typically, a closed ion source 30, such as shown in FIG. 2, that is used for process monitoring is operated to produce ions with approximately 6–8 electron volts of ion energy. The ion energy of the resulting ions entering the mass analyzer (not shown in FIG. 2)is reduced by the negative potential that is produced by the insulating layer effect described above, drastically reducing sensitivity for closed ion source QMS units.

There are two traditional solutions for solving the above problem that are currently practiced in accordance with the known art. The first solution is a total replacement of the ion source. This solution is extremely expensive in that the ion source includes a number of components in addition to the anode. This first solution is also time consuming. The second solution is replacement of the standard anode. The latter solution requires a disassembly of the ion source in addition to a replacement of the anode. In all likelihood, the latter solution also requires a replacement of the filament, thereby incurring additional repair costs.

In the ion source 10, the side or lateral entry of reagent gas through port 22 lends itself to removal of the anode 18 along the axis 25 of the ion beam 26 for removal thereof. In the closed ion source 30 in which the reagent gases enter the source along the ion beam axis 25, the anode 32 is typically an integral part of the ion source 30. The disassembly sequence for replacing the anode 32 requires the removal of a number of component parts including the sealing disk 34, a compression spring (not shown), the heated filament 14, and then the actual anode structure prior to replacement. Replacement of the anode 32 for axial gas entry closed ion sources is therefore a major rework of the ion source assembly. As noted, minimally the anode assembly is replaced but also the filament 14 more than likely also requires replacement. This is especially true if the filament is made from tungsten, due to its brittle nature and the risk of fracture of the filament on assembly. A new (e.g., unheated) tungsten filament is much less brittle than one that has already been heated. Often, a user may opt to replace the complete ion source other than to perform disassembly in the field.

SUMMARY OF THE INVENTION

It is a primary object of the present invention to overcome the above noted problems of the prior art.

It is another primary object of the present invention to increase the useful life of an ion source for a mass spectrometer or similar apparatus by permitting field replacement of a disposable component that can be introduced relative to the anode structure without compromising the overall sensitivity of the ion source.

Therefore and according to a preferred aspect of the present invention, there is provided an ion source for a mass analysis system, said ion source comprising:

means for forming an electron stream;

an anode having an interior region into which said formed electron stream is injected, said electron stream terminating within the anode region and in which ions are formed; and a releasable anode liner, said anode liner being insertable into said interior anode region and configured to receive said electron stream therein.

According to another preferred aspect of the present invention, there is disclosed a replaceable anode liner for an ion source, said ion source comprising having means for creating an electron stream disposed in relation to the interior of an anode support structure, said liner being releasably engageable with said ion source and configured to fit within said anode support structure.

Preferably, the replaceable or sacrificial anode liner comprises a sleeve-like portion that is fitted within the interior of the fixed anode of the ion source, said liner further including indexing means for orienting said liner with respect to the electron stream creating means, such as a filament, when said liner is placed onto said anode. According to one preferred embodiment, the liner has an indexing means and a tensioning means, each accomplished by means of a T-shaped slot formed on one end of the liner that is aligned with a reference feature on the anode structure. A lateral slot formed on the opposing end of the liner is indexed automatically relative to the electron stream creating means, such as a filament, in the case of a closed ion source, when the T-shaped slot is initially aligned with the reference feature on the anode structure.

The liner includes means to permit insertion and removal thereof, without requiring disassembly of the ion source; that is, the liner can be assembled to and removed directly from the fixed anode using a removal tool.

Preferably, the liner is designed to maintain a close sliding fit within the exterior of the anode, such that gas does not leak along a path between the interior of the ion source anode and the exterior of the liner to the low-pressure side of the ion source anode.

According to yet another preferred aspect of the present invention, there is provided an ion source assembly for a gas analysis system, said assembly comprising:

an ion source including at least one filament, an anode structure into which a formed electron beam from said filament enters, a gas port that permits the entry of process gases for analysis and a plurality of anode liners wherein an anode liner is insertable into the interior of said anode structure, each of said liners being made from an electrically conductive material and having means for permitting at least a portion of said electron stream to enter the interior of said anode structure.

According to yet another aspect of the present invention, there is disclosed a method for improving the sensitivity of a contaminated ion source, said ion source including an anode structure defining an interior region, said interior anode region receiving an electron stream wherein ions are formed in said region, said method comprising the steps of:

inserting a replaceable anode liner into the anode structure such that said liner is disposed in said interior anode region and receives said electron stream, said liner being made from an electrically conductive material permitting insulating deposits from said electron stream to form on an interior surface thereof in lieu of the interior of said anode structure.

An advantage of the present invention is that the anode liner, as herein described, permits the entire useful life of the ion source to be realized without significant disassembly or replacement of critical componentry.

Another direct advantage that is realized by the present invention is that the herein described anode liner(s) can be fabricated in a manner that can effectively control the emission of the electron beam into the anode region, depending on the application of the ion source of the hardware (e.g., mass spectrometer) that is being utilized.

Yet another advantage is that the liner as herein described does not significantly affect the sensitivity of the ion source when a liner is initially installed, that is, prior to contamination. Moreover, a methodology and design is described that effectively centers and aligns the liner relative to the formed electron beam of the ion source automatically upon insertion thereof.

Yet another advantage of the present invention is that effective contamination control is performed using a disposable component without sacrificing or significantly affecting the overall sensitivity of the ion source.

The preferred embodiment accomplishes restoration of ion source sensitivity with a low cost replacement element and time-saving replacement method over the known techniques of replacing the complete ion source or anode.

These and other objects, features and advantages will become readily apparent from the following Detailed Description which should be read in conjunction with the accompanying drawings.

BRIEF DESCRIPTION OF THE DRAWINGS

FIGS. 4(*b*) and 4(*c*) represent side elevational views of the anode liner of FIG. 4(*a*);

DETAILED DESCRIPTION

The present invention is herein described in terms of certain preferred embodiments in terms of a replaceable anode liner, as well as the forms of ion sources that the herein described covers can be used in conjunction with. It will be readily apparent from the discussion that follows to those of sufficient skill in the field, however, that other modifications and variations are possible within the spirit and scope of the intended invention. In addition, certain terms are used repletely throughout the discussion such as "top", "bottom", "lateral", "above", "beneath", "side" and the like. These terms are used in order to provide a frame of reference with regard to the accompanying drawings and are not intended to be overly limiting, except where specifically indicated to the contrary.

Figure 1:
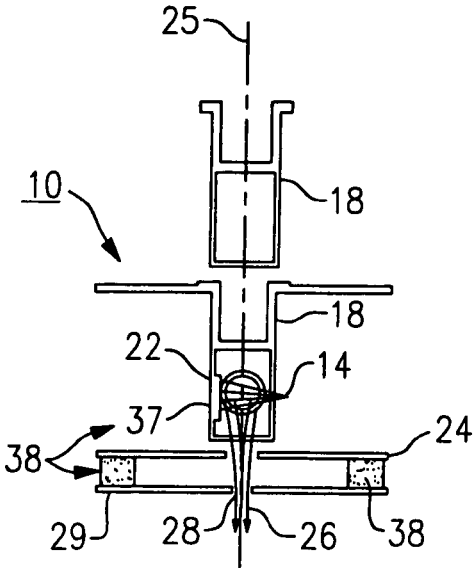
FIG.1 Prior Art
FIG. 1 is a partial side elevational view, taken in section, of a prior art ion source.
Figure 2:
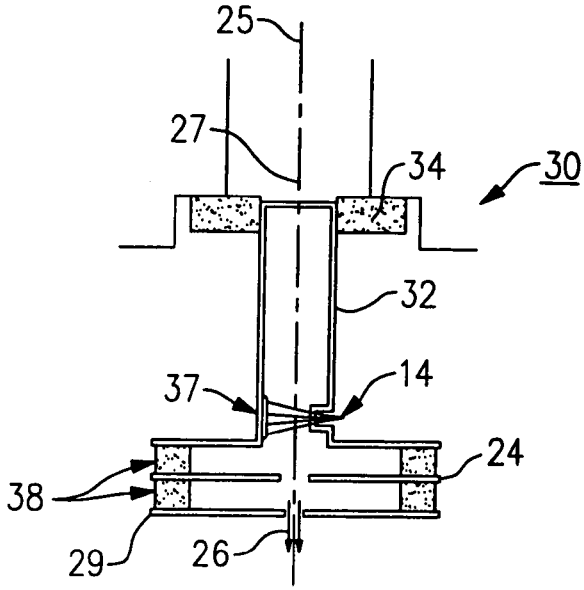
FIG.2 Prior Art
FIG. 2 is a partial side elevational view, taken in section, of another prior art ion source.
Figure 3:
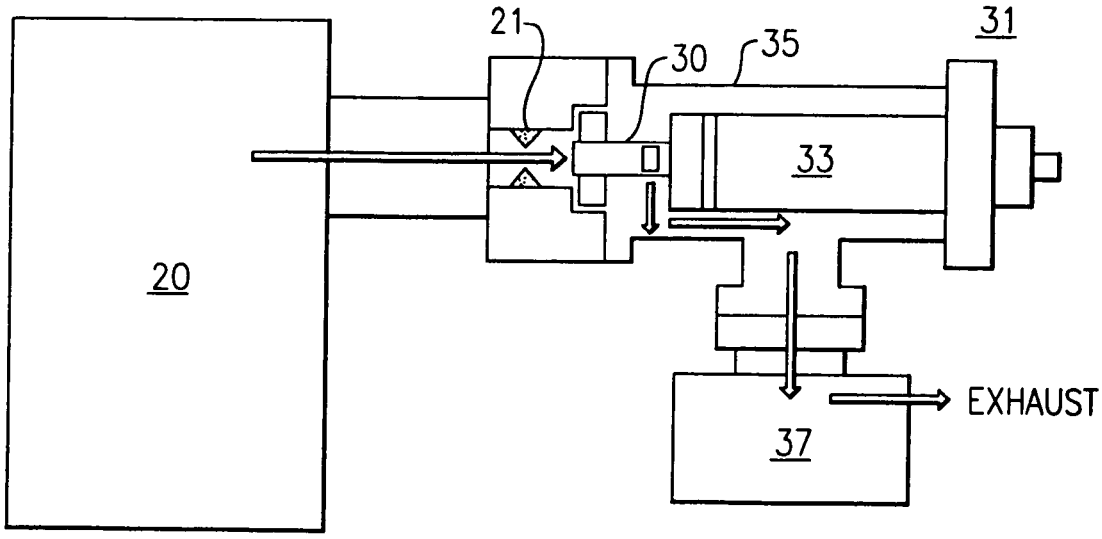
FIG. 3 depicts an ion source as used in a mass spectrometer system for use in a semiconductor monitoring process.
Figure 4C:
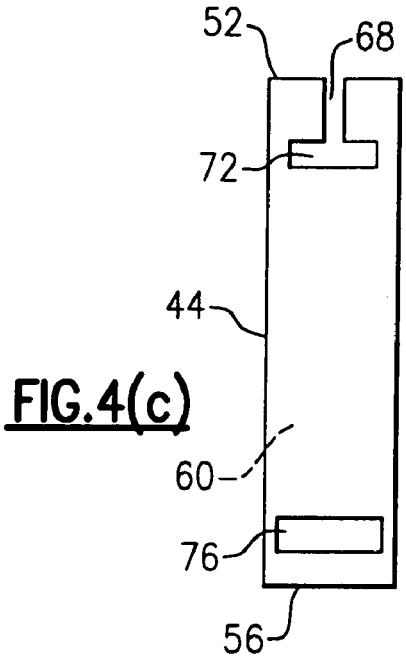
FIG. 4(*a*) is a partial side elevational view, taken in section, of an ion source having a replaceable anode liner fabricated in accordance with a preferred embodiment of the present invention.
Figure 4B:
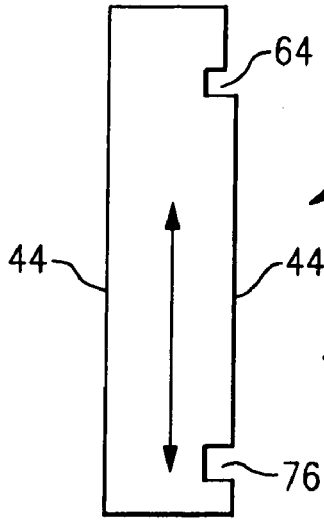
Figure 4A:
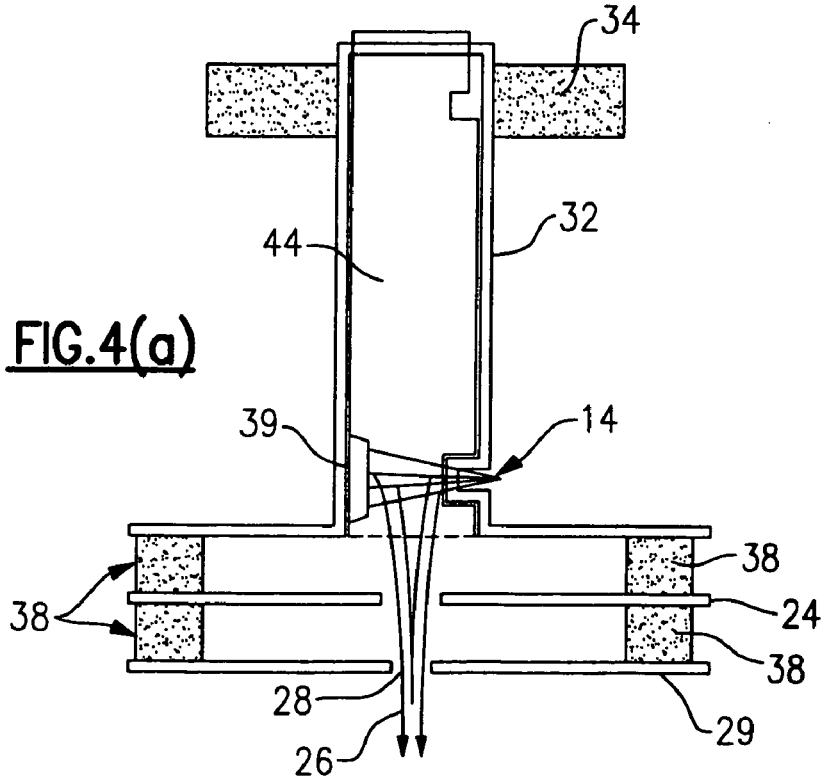

Turning to FIG. 4(*a*), there is shown a closed ion source 40, such as that previously represented in FIG. 2. For purposes of the discussion herein, similar parts are labeled with the same reference numerals. As in the preceding, the ion source 40 includes an anode structure 32 that is aligned relative to a heated filament 14 serving to form electrons that are projected into an interior portion of the anode. The ion source 40 further includes an ion lens assembly that includes a focus plate 24 and a concentric exit lens, each having openings 28 that focus and direct an extracted ion beam 26 from the anode region to a mass filter (not shown). Reagent gases enter the anode region axially; that is, from the upper portion of the anode structure in a direction that is parallel to the axis 25 of the ion beam 26. The assembly is sealed by means of a sealing disk 34 mounted to the top of the anode structure, and insulators 38 mounted in the ion lens assembly.

The assembly further includes a sacrificial anode liner 44, shown in FIGS. 4(*a*)–4(*c*), that is made in accordance with a first embodiment of the present invention. The anode liner 44 according to this embodiment is defined by a cylindrical sleeve-like housing 48 comprising a pair of open ends 52, 56 that further define a hollow interior 60. The liner 44 is constructed from any electrically conductive material, though according to this specific embodiment, the liner is constructed from 304 stainless steel with gold plating. The liner 44 is thin-walled, for reasons better explained below and is relatively light weight, the liner being sized to tightly fit within the interior of the fixed anode structure 32 of the ion source 40 and more particularly the anode region into which ions are formed, as shown in FIG. 4(*a*).

Referring particularly to FIGS. 4(*b*) and 4(*c*), the anode liner 44 further includes a T-shaped slot 64 having a vertical portion 68 and a horizontal or lateral portion 72, the slot extending in the proximity of a first or top open end 52 as well as a lateral slot 76 that is formed proximate to an opposing second or bottom open end 56 thereof. The T-shaped slot 64 is shaped to a large diameter relative to the remainder of the liner outer diameter as a means for both tensioning and holding the liner 44 in place when inserted. The T-shaped slot 64 is configured in order to permit engagement by an insertion/removal tool 80, FIG. 5, for assembling/mounting of the liner 44 relative to the anode structure, as described in greater detail below. The lateral slot 76 of the liner 44 is sized for alignment with the electron producing source (in this instance, the heated filament 14, FIG. 4(*a*)) of the ion source 40, FIG. 4(*a*) in order to permit electrons to penetrate the interior of the anode 32, FIG. 4(*a*) in the usual manner. However and due to the presence of the anode liner, any insulating deposits that would typically form from either or both of the surface adsorbed species and the gas phase species on the interior of the anode will now form on the interior surface of the conductive interior surface of the anode as electrons strike the interior wall of the liner 44, depositing ion energy, raising the wall temperature thereof and allowing deposits to form.

Figure 5:
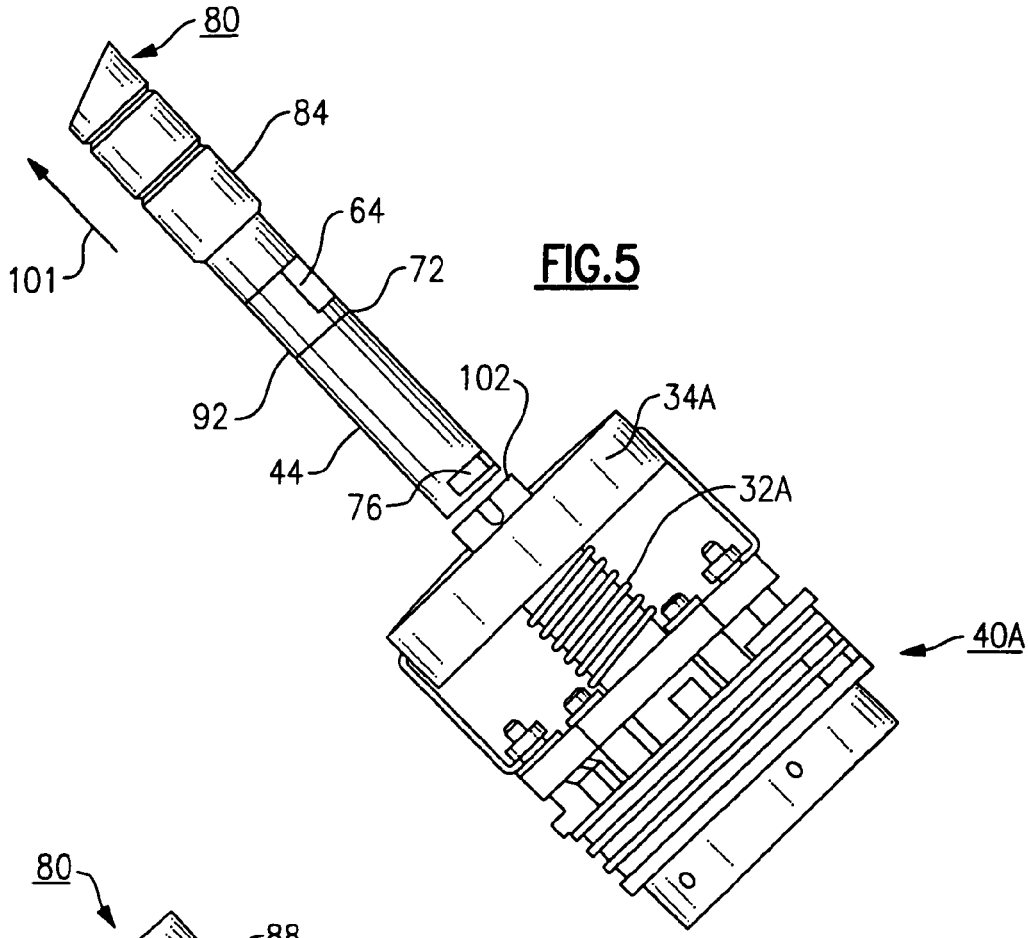
FIG. 5 is a perspective view illustrating the removal of the liner of FIGS. 4(*a*)–4(*c*) from an ion source in accordance with a particular embodiment of the invention.
Figure 6:
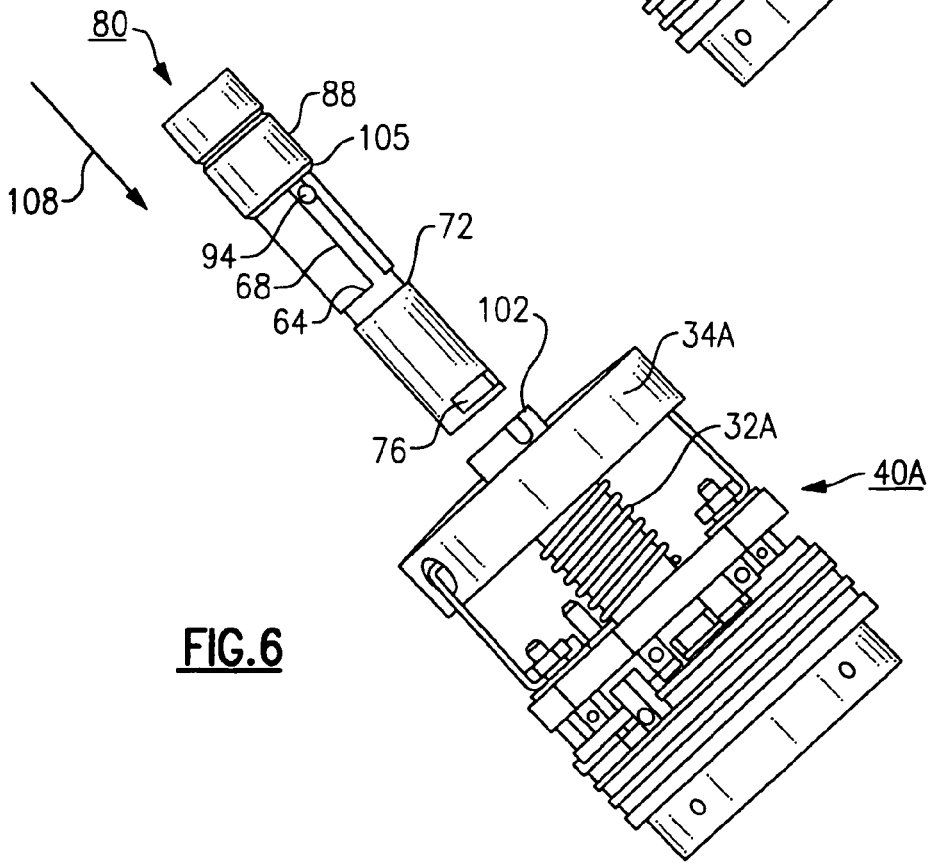
FIG. 6 depicts a perspective view of the attachment/replacement of the anode liner of FIGS. 4(*a*)–4(*c*) onto the ion source of FIG. 5.

FIGS. 5 and 6 depict the removal and the subsequent replacement of a sacrificial anode liner 44 in accordance with the invention in relation to a closed ion source 40A, similar to that described above. An insertion/removal tool 80 used therewith is defined by a cylindrical member having a pair of opposing ends; namely, an insertion end 88 and a removal end 84, respectively.

Referring first to FIG. 5, the apparatus depicted therein already assumes that a sacrificial anode liner 44, as described above, is already in place relative to the fixed anode structure 32A of the closed ion source 40A. The insertion/removal tool 80 of this specific embodiment has a diameter that is sized to engage the interior of the anode structure 32A and the interior of the already inserted anode liner 44. The tool 80 is inserted into the anode until an alignment removal pin 92 projecting from the tool bottoms out on the horizontal portion 72 of the T-shaped slot 64. The tool 80 is then rotated about its center axis until it meets with the end of the horizontal portion 72 of the T-shaped slot 64. It does not matter for purposes of liner removal whether the tool 80 is rotated clockwise or counterclockwise. Once the tool alignment removal pin 92 is engaged with the lateral portion 72 of the T-shaped slot 64, the liner 44 can be pulled from the anode interior by retraction of the insertion/removal tool 80 as shown in direction 101.

Referring to FIG. 6, a new anode liner 44 can then replace the removed liner of FIG. 5. Insertion is made using the tool 80 and more specifically a tool alignment insertion pin 94 that projects radially from the exterior of the tool. The alignment insertion pin 94, according to this embodiment, is initially aligned along the vertical portion 68 of the T-shaped slot 64 of the sacrificial anode liner 44. The lateral slot 76 of the liner 44 is aligned, in accordance with this embodiment, automatically with the filament (not shown) of the ion source 40A by providing a small circumferential notch 102 in the uppermost point of the fixed anode 32A. This notch 102 is provided such that engagement of the tool alignment insertion pin 94 of the removal/insertion tool 80 therewith will automatically align or index the lateral slot 76 in the bottom of the liner 44 with the electron stream source (e.g., the filament) of the ion source 40A. Insertion is then performed axially in direction 108, the insertion end permitting insertion to a predetermined axial distance within the anode structure by means of a shoulder 105. The height of the anode liner 44 is set to be slightly higher than that of the anode 32 such that, when fully inserted, the liner projects outwardly above the top of the anode very slightly, thereby ensuring that the liner is fully inserted.

As such, insertion effectively aligns and centers the electron entrance slot of the liner 44 relative to the filament 14 automatically without the need for additional aids or inspection.

Preferably and in operation, the herein described sacrificial or replaceable anode liner 44 would be initially incorporated into the interior of the anode structure of an ion source, the anode structure further including the circumferential notch 102. The thickness of the liner 44 must be sufficiently thin in order to preserve the sensitivity of the ion source, partially controlled by the dimensions of the ionization region within the anode.

Verification testing was performed to verify the use of a prototype sacrificial liner, such as that described above, in an ion source assembly. For purposes of this testing, the ion source was a CVD version closed ion source manufactured by Inficon, Inc. Testing was performed using a Phase 2 Compact Process Monitor which was equipped with a quadrupole mass filter to determine the effect of sensitivity as measured both without the presence of a sacrificial anode liner and with the inclusion of a said liner 44, as described above.

| Configuration | Sensitivity (A/Torr) |
|---|---|
| Closed Ion Source without an Anode Liner | $1.20 \times 10^{-5}$ |
| Closed Ion Source with an Anode Liner inserted | $1.15 \times 10^{-5}$ |
| Closed Ion Source without an Anode Liner (Removed) | $0.95 \times 10^{-5}$ |

A second comparison was performed using a contaminated ion source measured before and after insertion of a sacrificial anode liner, as described above.

| Configuration | Sensitivity (A/Torr) |
|---|---|
| Closed Ion Source Contaminated with $SiO_2$ from $SiCl_4$ Operation | $0.45 \times 10^{-5}$ |
| Contaminated Closed Ion Source with an Anode Liner inserted | $1.4 \times 10^{-5}$ |

Figures 7, 8, 9:
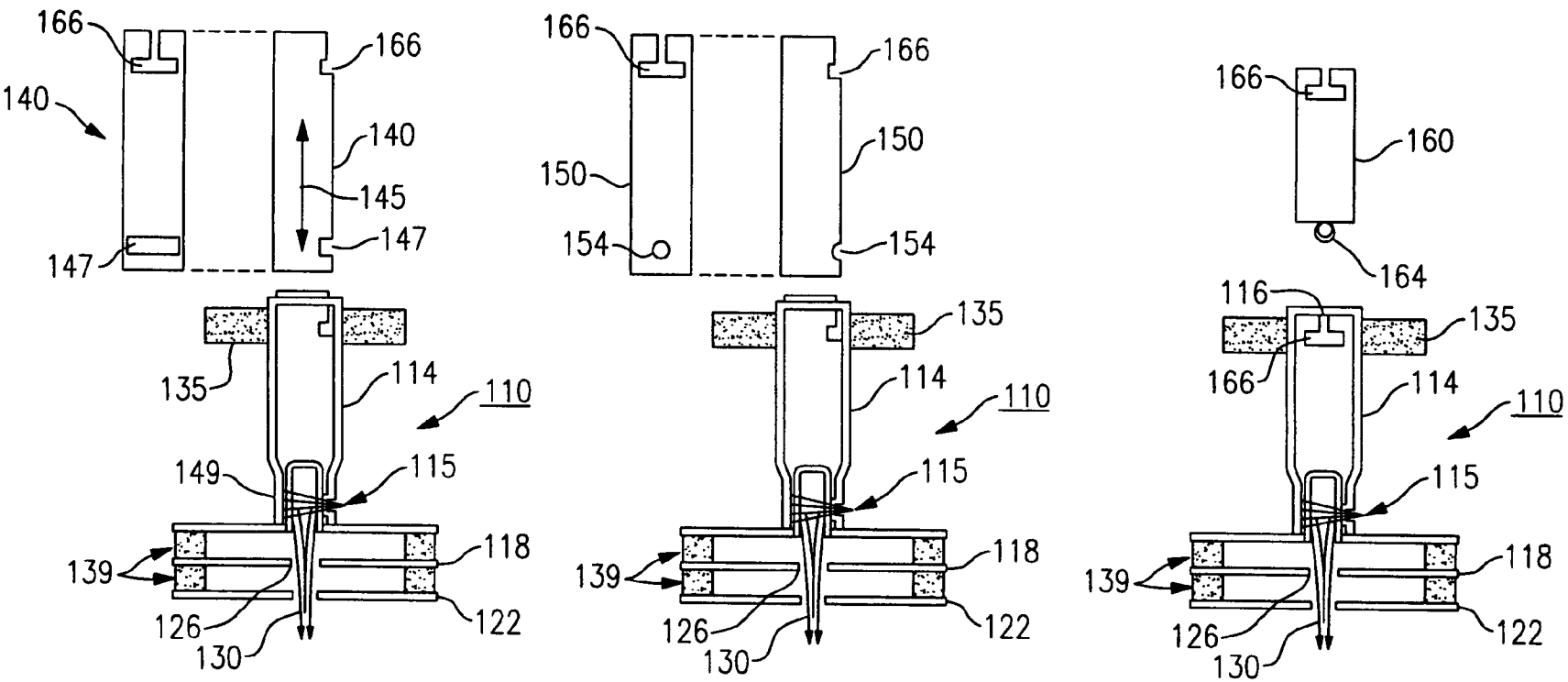
FIG. 7 illustrates a side view of an anode liner in accordance with a second embodiment of the present invention.
FIG. 8 illustrates a side view of an anode liner made in accordance with a third embodiment of the present invention.
FIG. 9 illustrates a side view of an anode liner that is fabricated in accordance with a fourth embodiment of the present invention.

According to yet another embodiment of the present invention, the sacrificial anode liner can be designed so as to control the flow of electrons into the ionization volume. A multi-purpose or "universal" ion source 110 is depicted in FIGS. 7–9 that can individually accommodate a plurality of multiple sized or designed anode liners. The ion source 110 is of the closed form type and includes an anode structure 114 as well as a filament 115 serving as an electron source. The source 110 further includes an ion lens assembly that includes a conductive focus plate 118 and an ion exit lens 122, each having a concentric opening 126 that permits an ion beam 130 to pass therethrough. Process reagent gases enter the ion source 110 axially (with respect to the formed ion beam 130) through the anode structure 114 and exit through the ion lens assembly as well as the filament. The ion source 110 is otherwise sealed for gas leakage by means of a sealing disk 135 disposed at the top of the anode structure 114 and insulators 139 provided at the ion lens assembly.

According to one variation shown in FIG. 7, a sacrificial anode liner 140 is defined as a cylindrical sleeve member designed and sized to fit within the interior of the anode structure 114. The liner 140 is a thin-walled structure made from an electrically conductive material and includes a pair of opposite open ends that define a hollow interior. An electron entrance slot 147 is provided at the bottom end thereof which aligns with the filament 115 in order to permit formed electrons to enter the interior of the anode structure 114. As in the preceding, and rather than forming on the interior of the anode structure 114, any insulating deposit from the reagent gases will subsequently form as a layer 149 instead on the interior surface of an opposite wall of the liner 140, that is, opposite from the entrance electron slot 147, the liner being electrically conductive thereby promoting same. The liner 140 is shown in the figure in both the assembled and unassembled condition, the liner being insertable and removable in the direction 145.

Referring to FIG. 8, another version of a sacrificial liner 150 is illustrated for use with the ion source 110. In this specific embodiment, the design of the liner 150 is literally identical to that of FIG. 7, other than that the lateral electron entrance slot at the bottom end of the liner is replaced with a smaller opening 154 that controls the admission of electrons into the closed ion source, such as for use in PVD (Physical Vapor Deposition) processes. The smaller electron entrance opening 154 reduces the conductance of gas out the electron entrance and therefore raises the pressure inside the anode region.

A third liner 160, illustrated in FIG. 9, is similar in design to the previous liners 140, 150 but in this liner the lateral electron entrance slot is removed and the open lower end of the liner is replaced by a single or multiple gas effusion opening 164 in the lower end of the liner 160. The latter design is useful in that only a molecular beam of gas is flowed through the anode region. In each of the above liner designs, however, only a single anode structure and ion optics assembly is required.

The remainder of the design of each of the above liners commonly includes an upper open end that includes a T-shaped slot 166, as described above, wherein the anode structure 114 can similarly be configured with a circumferential notch 116, shown only in FIG. 9, to permit indexing of each liner 140, 150, 160 relative to the filament 115. An insertion tool, such as shown in FIGS. 5 and 6, can therefore be used to easily import and remove liners 140, 150, 160, as needed, relative to the ion source 110, either for contamination control and improved life of the ion source or for utilizing different applications, such as PVD, among others.

PARTS LIST FOR FIGS. 1–9

10 ion source
14 electron source (heated filament)
18 anode
20 gas supply
21 flow control valve
22 gas port
23 calibration pressure gauge
24 focus plate
25 ion beam axis
26 on beam
27 direction
28 openings

29 exit lens
30 ion source
31 mass analysis system
32 anode
32A anode structure
33 sensor
34 sealing disk
35 vacuum chamber
37 vacuum pump
38 insulators
39 insulating deposit layer
40 ion source
40A ion source
44 anode liner
52 open end
56 open end
60 interior
64 T-shaped slot
68 vertical portion
72 horizontal or lateral portion
76 lateral slot
80 insertion/removal tool
84 removal end
88 insertion end
92 tool removal alignment pin
94 tool insertion alignment pin
101 direction
102 circumferential notch
105 shoulder
108 direction
110 ion source
114 anode structure
115 filament
116 circumferential notch
118 focus plate
122 ion exit lens
126 openings
130 ion beam
135 sealing disk
139 insulators
140 sacrificial anode liner
145 direction
147 electron entrance slot
149 insulating deposit layer
150 sacrificial anode liner
154 electron entrance opening
160 liner
164 gas effusion opening
166 T-shaped slot It will be readily apparent that there are many variations and modifications that are possible within the ambits of the herein described invention to those of sufficient skill in the field according to the following claims. For example, there are other forms of ion source where the anode is neither cylindrical nor is its long axis concentric with the long axis of the sensor. The above anode liner concept can also be useful in these ion sources. In such cases, a retention spring could be integrated into the liner section itself or other means such as a screw or the like could retain the liner in position. Similarly, a spring effect could be realized by slightly crushing the top of the liner until it is slightly oval in cross section. A spring could also be formed by placing two parallel cuts in the long axis of the cylinder, forming a tab, which could be bent outwardly slightly to improve retention force.

Additionally, other alignment features could similarly be realized using the tab, for example, or no alignment other than visually may be necessary.

We claim:

1. An ion source for a mass analysis system, said ion source comprising:

means for forming an electron stream;

an anode having an interior region into which said formed electron stream is injected, said electron stream terminating within the anode region and in which ions are formed; and a releasable anode liner, said anode cover being releasably insertable into said interior anode region and configured to receive said electron stream therein, said anode liner being an open-ended sleeve member that is sized to fit within said interior anode region in an axial orientation relative to the formed electron beam of said ion source, said anode cover being insertable and removable from said anode interior region without requiring disassembly thereof.

2. An ion source as recited in claim 1, further including ion extraction means for extracting ions from said anode region.

3. An ion source as recited in claim 2, including means for admitting at least one reagent gas from a process being monitored by said system.

4. An ion source as recited in claim 3, wherein said at least one reagent gas is admitted axially with respect to a formed ion beam created by said ion extraction means.

5. An ion source as recited in claim 1, wherein said releasable anode liner includes an interior surface where electrons entering said interior anode region strike and deposit energy and onto which deposits can adhere from at least one of surface adsorbed species and gas phase species.

6. An ion source as recited in claim 1, wherein said releasable anode liner includes electron entry means for permitting at least a portion of said created electron stream to enter said anode region when said liner is inserted therein.

7. An ion source as recited in claim 1, wherein said electron entry means includes at least one lateral slot provided on said releasable anode liner.

8. An ion source as recited in claim 1, including an insertion and extraction tool for permitting said releasable anode liner to be selectively inserted and removed from the interior anode region.

9. An ion source as recited in claim 8, wherein said releasable anode liner includes at least one attachment and removal slot provided on one end of said liner, said insertion and extraction tool having at least one pin for engaging said at least one attachment and removal slot for permitting insertion and removal without disassembly of said anode structure.

10. An ion source as recited in claim 6, including means for aligning said electron entry means of said releasable anode liner with said electron stream forming means when a said liner is inserted into said anode region.

11. An ion source as recited in claim 10, wherein said aligning means includes a reference feature provided within said anode structure, said reference feature being aligned with a portion of said insertion and extraction tool after a liner has been initially releasably assembled thereto to provide indexing of said liner relative to said electron stream forming means when a said liner is assembled thereto.

12. An ion source as recited in claim 1, wherein said electron stream forming means includes a heated filament.

13. An ion source as recited in claim 1, wherein said anode liner is made from an electrically conductive material.

14. A replaceable anode liner for an ion source, said ion source comprising means for creating an electron stream disposed in relation to the interior of an anode support structure, said liner being releasably engageable with said anode support structure and configured to fit within the interior thereof such that said liner can be selectively and releasably inserted and extracted without disassembly of said anode structure being required.

15. An anode liner as recited in claim 14, including means for automatically indexing said replaceable anode liner relative to said electron stream producing means of said ion source when said liner is inserted into the interior of said anode structure.

16. An anode liner as recited in claim 15, wherein said liner is a cylindrical sleeve member having a diameter that is sized to fit within the interior of said anode structure.

17. An anode liner as recited in claim 16, wherein said liner is made from an electrically conductive material.

18. An anode liner as recited in claim 17, including a first slot sized to permit electrons from said electron stream forming means to flow to the interior of said anode and the interior of said liner such that insulating deposit from entering reagent gases will adhere to the interior of said anode liner.

19. An anode liner as recited in claim 18, including a second slot sized for engagement with a tool for selectively removing and inserting said liner relative to an ion source.

20. An anode liner as recited in claim 19, wherein said second slot is substantially T-shaped for engagement with a pin of said tool, wherein the engagement of said second slot with said pin permits each of inserting and removing of a said liner relative to said ion source.

21. An ion source assembly for a gas analysis system, said assembly comprising:

an ion source including at least one filament, an anode structure having an interior region into which a formed electron beam from said filament enters, a gas port that permits the entry of process gases for analysis and a plurality of replaceable anode liners wherein an anode liner is selectively and releasably insertable into the interior of said anode structure, each of said liners being made from an electrically conductive material and having means for permitting at least a portion of said electron stream to enter the interior of said anode structure, said liner being insertable and extractable from the interior of said anode structure without requiring the disassembly thereof.

22. An ion source assembly as recited in claim 21, including means for extracting ions from said interior region of said anode structure.

23. An ion source assembly as recited in claim 21, wherein said ion source is a closed ion source.

24. An ion source assembly as recited in claim 21, wherein at least one of said replaceable anode liners includes an opening sized for permitting at least a portion of said electron beam to enter the interior anode region.

25. An ion source assembly as recited in claim 21, wherein at least one of said replaceable anode liners includes a gas effusion port.

26. An ion source assembly as recited in claim 24, wherein said opening is a lateral slot.

27. An ion source assembly as recited in claim 21, wherein each of said anode liners controls the electrons entering said anode region, said ion source being useful in monitoring each of PVD and CVD processes.

28. An ion source assembly as recited in claim 24, including means for automatically indexing the opening relative to said electron stream producing means when a said liner is inserted into said anode structure.

29. An ion source assembly as recited in claim 21, wherein each of said replaceable anode liners prevent accumulation of surface deposits on the interior of said anode when inserted in the interior anode region of said ion source.

30. A method for improving the sensitivity of a contaminated ion source, said ion source including an anode structure defining an interior region, said interior anode region receiving an electron stream wherein ions are formed in said region, said method comprising the steps of:

inserting a replaceable anode liner into the interior of the anode structure such that said liner is disposed in said interior anode region and receives said electron stream, said liner being an open-ended sleeve member which is inserted without requiring disassembly of said anode structure said liner being made from an electrically conductive material permitting insulating deposits from said electron stream to form on an interior surface thereof in lieu of the interior of said anode structure.

31. A method as recited in claim 30, wherein said inserting step includes the steps of:

placing one end of said replaceable anode liner onto one end of an insertion tool; and inserting said liner into the interior of said anode structure.

32. A method as recited in claim 31, further including the step of aligning an electron entry means of said releasable anode liner relative to an electron stream forming means of said ion source during said inserting step.

33. A method as recited in claim 32, wherein said aligning step includes the steps of:

mounting one end of said replaceable anode liner to the end of an insertion tool, said mounting step including the additional steps of:

aligning a pin of said insertion tool with an assembly slot of said liner; and slipping said liner over said insertion tool such that said pin is placed in said assembly slot; and aligning said assembly pin with a reference feature provided on said anode structure wherein insertion of said liner automatically aligns the electron entry means of said liner with said electron stream forming means.

34. A method as recited in claim 33, including the step of selectively removing said liner after a predetermined time for replacement thereof, said removing step being performed without requiring disassembly of said anode structure.

35. A method as recited in claim 34, wherein said removal step comprises the steps of:

aligning a removal tool with said liner such that a T-shaped slot of said liner is aligned with a pin of said removal tool;

rotating said tool about a center axis to permit said pin to engage said slot; and axially removing said releasable anode liner from said anode structure.

* * * * *